US005897034A

United States Patent [19]

Sewell

[11] Patent Number: 5,897,034

[45] Date of Patent: Apr. 27, 1999

[54] DISPENSING DEVICE SUCH AS A PIPETTE

[76] Inventor: Miles Atholl Blackwood Sewell, 47 Norfolk Road, Maidenhead, Berkshire, SL6 7AU, United Kingdom

[21] Appl. No.: 08/640,918

[22] PCT Filed: Nov. 9, 1994

[86] PCT No.: PCT/GB94/02463

§ 371 Date: Aug. 2, 1996

§ 102(e) Date: Aug. 2, 1996

[87] PCT Pub. No.: WO95/13138

PCT Pub. Date: May 18, 1995

[30] Foreign Application Priority Data

Nov. 11, 1993 [GB] United Kingdom ..... 9323252

[51] Int. Cl.[6] ..... B67D 5/42

[52] U.S. Cl. ..... 222/386; 73/864.01

[58] Field of Search ..... 222/386; 604/227; 422/100, 923; 73/864.01

[56] References Cited

U.S. PATENT DOCUMENTS

| | | | |
|---|---|---|---|
| 3,735,900 | 5/1973 | Gores | 222/386 |
| 3,828,987 | 8/1974 | Drummond et al. . | |
| 3,848,777 | 11/1974 | Sarstedt et al. . | |
| 4,276,878 | 7/1981 | Storz . | |
| 4,487,081 | 12/1984 | De Vaughn et al. . | |
| 4,493,704 | 1/1985 | Beard et al. . | |
| 4,662,545 | 5/1987 | Kenney | 222/386 |
| 5,052,588 | 10/1991 | Schlosser | 222/386 |
| 5,261,882 | 11/1993 | Sealfon . | |

FOREIGN PATENT DOCUMENTS

| | | |
|---|---|---|
| 0443227 | 8/1991 | European Pat. Off. . |
| 2628006 | 9/1989 | France . |
| 443723 | 2/1968 | Switzerland . |

*Primary Examiner*—Philippe Derakshani
*Attorney, Agent, or Firm*—Renner, Otto, Boisselle & Sklar, P.L.L.

[57] ABSTRACT

In order to provide a pipette device which is easier and more accurate to use than those using known pipette fillers, a piston (2), which is preferably flexible, is provided to fit into the pipette bore (6). The plastics piston rod (1) sits conveniently in a guide cap at the mouth of the pipette tube and the piston rod is operated by stroking its upper surface, which is serrated along its length, with a digit; thus dispensing by a positive displacement method.

13 Claims, 10 Drawing Sheets

DISPENSING DEVICE SUCH AS A PIPETTE

FIELD OF THE INVENTION

This invention relates to dispensing devices such as pipettes.

BACKGROUND OF THE INVENTION

In laboratories, pipettes are often used in conjunction with pipette fillers. Pipette fillers are commonplace titration aids which comprise a mechanism that is fitted over the end of the pipette and is operated manually to control the dispensing of the titrating fluid.

The pipette filler also protects the health and safety of the operator by removing the necessity for the operator to place their mouth over the non-dispensing end of the pipette is order to suck up the fluid; operators can pass on infections and harmful chemicals may be accidentally sucked into the mouth.

However, these known pipette fillers are relatively expensive. Moreover, they are prone to malfunction caused by leakage through their simple valve mechanisms. When fitted to the pipette, the known pipette fillers make the dispensing equipment top heavy, preventing the equipment being left to stand safely in smaller sized graduated cylinders. Also, the vacuum release principal on which the known pipette fillers work is an indirect control method, which results in poorer control of the dispensing process than is achievable by positive displacement methods.

U.S. Pat. No. 3,848,777 discloses a pipette for receiving and dispensing liquid wherein a plunger in a cylinder is connected to a plunger rod guided in the cylinder and the free end of the rod is U-shaped with a free end having a projection thereon to be engageable in any one of a series of grooves provided at spaced intervals along the outside of the cylinder so as to provide a detent system for dispensing of liquid, the U-shaped portion of the plunger rod having two corrugations to be engaged by the thumb of the user.

U.S. Pat. No. 4,493,704 discloses a portable syringe with a U-shaped thin flexible plunger stem which can be bent over to lie upon the outside of a body of the syringe, the plunger stem having closely spaced teeth thereon engaged by a screw driven by a motor to cause dispensing of liquid.

SUMMARY OF THE INVENTION

According to one aspect of the present invention, there is provided a dispensing device comprising a tube having a dispensing nozzle at one end and the other end being open, a piston head slidable in the tube, and a piston rod extending from the piston head and projecting from the open end of the tube, wherein the surface of the piston rod has a high coefficient of friction such that a force applied to the side of the piston rod adjacent the open end of the tube, by application by a digit of a user to the side of the piston rod adjacent the open end of the tube and at an inclined angle to the axis of the tube, can have a frictional component sufficient to move the piston rod and piston head along the tube.

This aspect of the invention therefore provides a simple construction of a simple to operate, positive displacement dispensing device in which the piston rod is directly responsive to the operator's digit.

According to another aspect of the invention, there is provided a dispensing device comprising a tube having a dispensing nozzle at one end and the other end being open, a piston head slidable in the tube, and a piston rod extending from the piston head and projecting from the open end of the tube so that the piston rod and piston can be manually moved along the tube, the piston rod being flexible so that as the piston head is urged by the piston rod towards the dispensing nozzle the piston rod is supported at least part-way along its length by the tube and that portion of the piston rod outside the tube curls up due to "plastics memory".

This aspect of the invention thus provides a simple construction of a positive displacement dispensing device in which the piston rod can hang down or be curled up, and which piston rod can be bent while operating the piston.

According to another aspect of the invention, there is provided a method of dispensing fluid from a dispensing device comprising a tube having a dispensing nozzle at one end and the other end being open, a piston head slidable in the tube, and a piston rod extending from the piston head and projecting from the open end of the tube, the method comprising the step of applying by a digit a force to the side of the piston rod adjacent the open end of the tube and at an inclined angle to the axis of the tube, such that the frictional component of the force is sufficient to move the piston rod and the piston head along the tube.

BRIEF DESCRIPTION OF THE DRAWINGS

Specific embodiments of the invention will now be described by way of example with reference to the accompanying drawings, in which.

DETAILED DESCRIPTION

Figure 1:
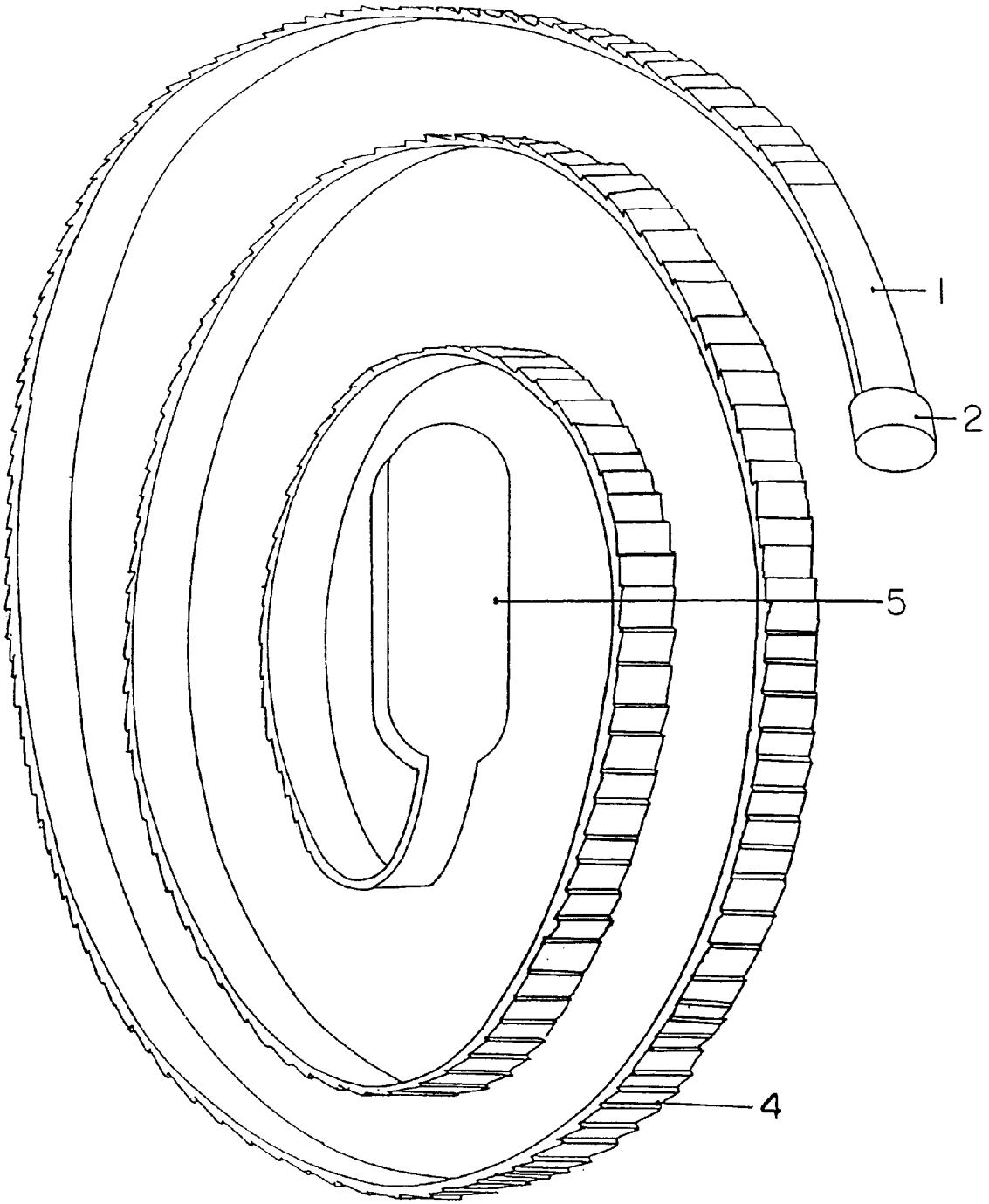
FIG. 1 shows in perspective a piston with a piston rod (1) curled in the unused state for use in a pipette assembly (according to one embodiment of the invention).
Figure 2:
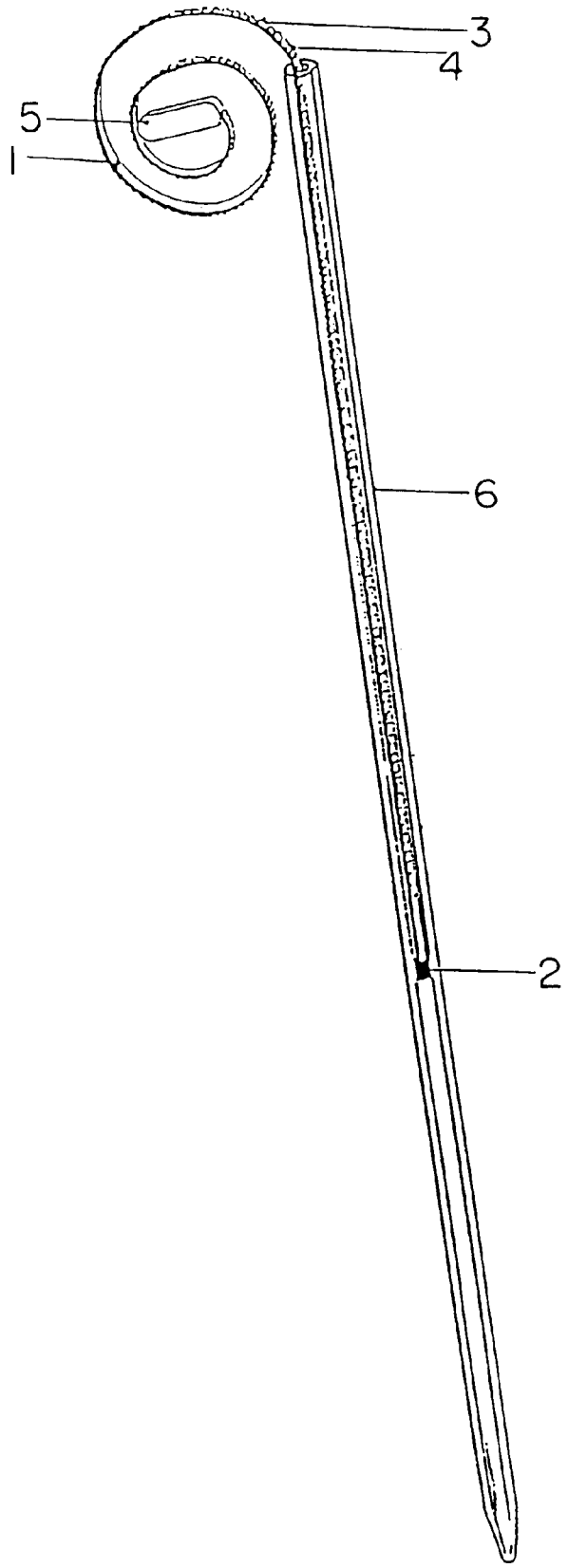
FIG. 2 shows in perspective the pipette assembly of the first embodiment with a piston head [2] inside a pipette tube [6] and the piston rod [1] partly uncurled.

Referring to the drawings, FIGS. 1 and 2 show the pipette assembly comprised of a piston rod [1] which may, due to its manufacture, possibly of suitable plastic material with the suitable plastic memory, roll up when it is extracted from the pipette tube [6]. The external surface [3] of the piston line is provided with a serrated finish [4] and the end of the piston rod which is at the centre of the curl is provided with a tag [5], for identification purposes. The other end of the piston rod is provided with a piston head [2], of suitable material, which seals against the walls of the pipette tube.

In order to fill the pipette tube, the piston [1, 2] is firstly fed into the pipette tube [6]. The jet end of the pipette tube is then inserted into the fluid and the piston is withdrawn, drawing the fluid into the pipette tube. The free end of the piston rod may curl up as in FIG. 2. The cross sectional shape of the piston rod is preferably rectangular or cylindrical but may be of any suitable shape.

To empty, the filled pipette tube [6] is held conventionally and the external serrated surface [4] of the piston rod is stroked with the index finger, or thumb, to feed the piston rod into the pipette tube, thereby dispensing the fluid by positive displacement.

Figure 4:
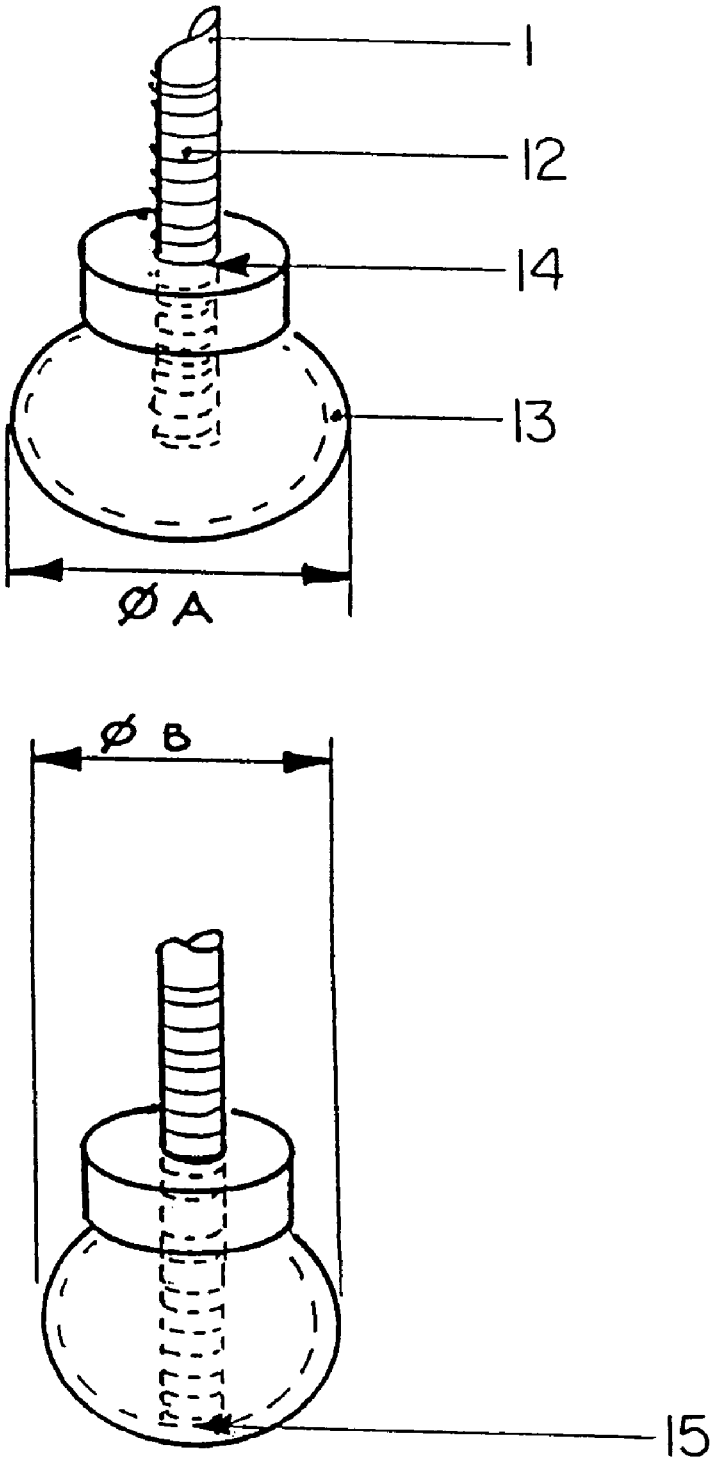
FIG. 4 shows in perspective a modified adjustable piston head assembly operable to adjust the diameter of a bulbous piston head [13].

An adjustable piston head may be provided, as shown in FIG. 4. A male thread [12] on the end of the piston rod [1] is provided with a bulbous rubber piston head [13] which is screwed onto the thread [12] by means of undersized hole [14]. As the bulb [13] is screwed onto the thread [12] the piston rod [1] will eventually cause elongation of the bulb [13] by pushing at point [15] on the bottom of the bulb. As the bulb [13] is elongated so its diameter reduces [øA to øB].

The piston head diameter may be adjusted while the piston head is loaded inside the pipette tube. By jamming the piston head into the jet end of the pipette, the bulb [13] is held tight and the piston rod [1] can be adjusted as required, by rotating the pipette tube [6] or piston rod [1].

Figure 5:
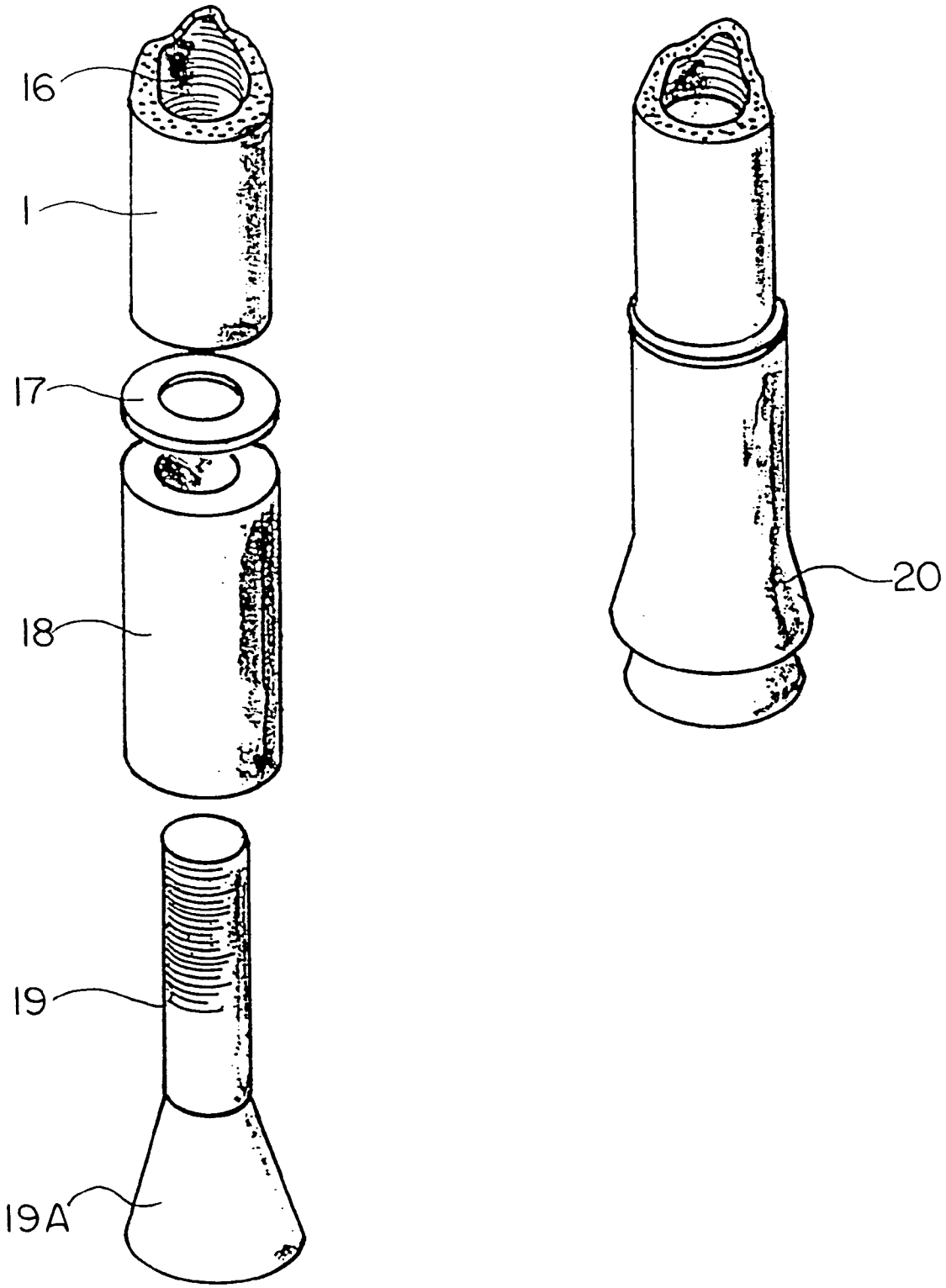
FIG. 5 shows a further modified adjustable piston head assembly as an exploded view and also as adjusted for use, a conical headed screw [19] screwed into an internal thread [16] of the piston rod [1].
Figure 6:
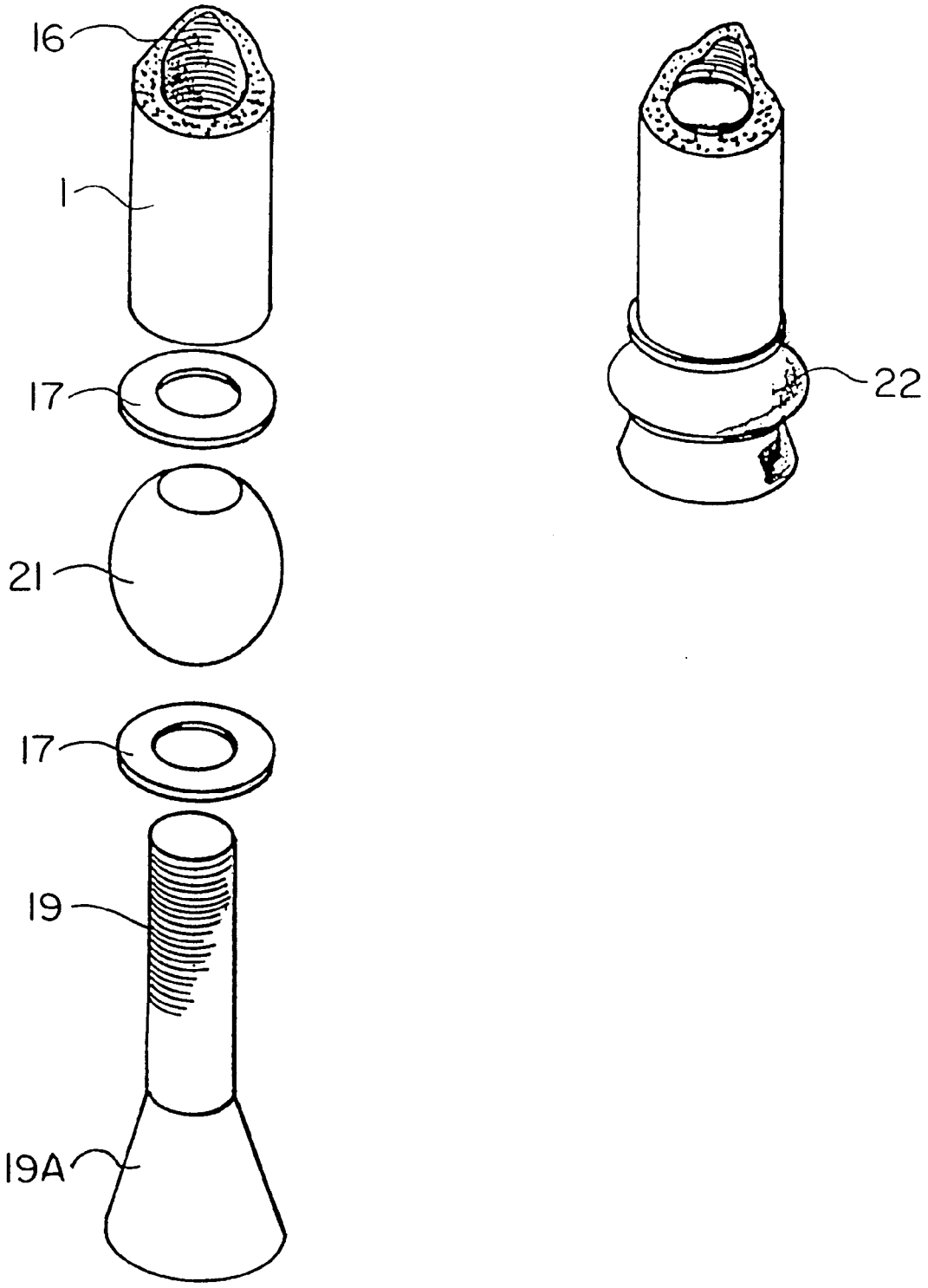
FIG. 6 shows another modified adjustable piston head assembly as an exploded view and as adjusted for use, with a conical headed screw [19] screwed into an internal thread [16] of the piston rod [1].

Another example of a piston provided with an adjustable piston head is shown in FIG. 5. The end of the piston rod is equipped with a female thread [16] into which a screw [19] with a conical head [19A] is assembled. The shaft of the screw [19] carries a length of tubular rubber [18] which is expanded [20] when the conical head [19A] is drawn into the rubber tube [18] by the action of screwing the screw [19] into the threaf [16]. Washer [17] may help retain the rubber [18]. The rubber [18] may be of the fluoroelastomer type to provide a low co-effecient of friction and high chemical resistance. Another adjustable piston head is shown in FIG. 6 where the piston rubber [21] is sperical or avoid in shape and is suitably constructed so thatwhen the rubber [21] is compressed between washers [17] its diameter is increased [22]. It will be appreciated that the screw 19/19A may be constructed with a female thread that screws onto a male thread on the piston rod, onto which parts 17, 18 and 21 may be assembled.

The diameter of adjustable piston heads shown in FIGS. 5 and 6 may be adjusted while the piston is loaded inside the pipette tube. By jamming the piston into the jet end of the pipette, and simultaneously rotating the piston rod (or pipette tube) in the desired direction, the screw [19] [21] and thereby its degree of expansion [20].

The conical headed screw [19] should be made from suitable material to resist chemical attack.

Figure 3:
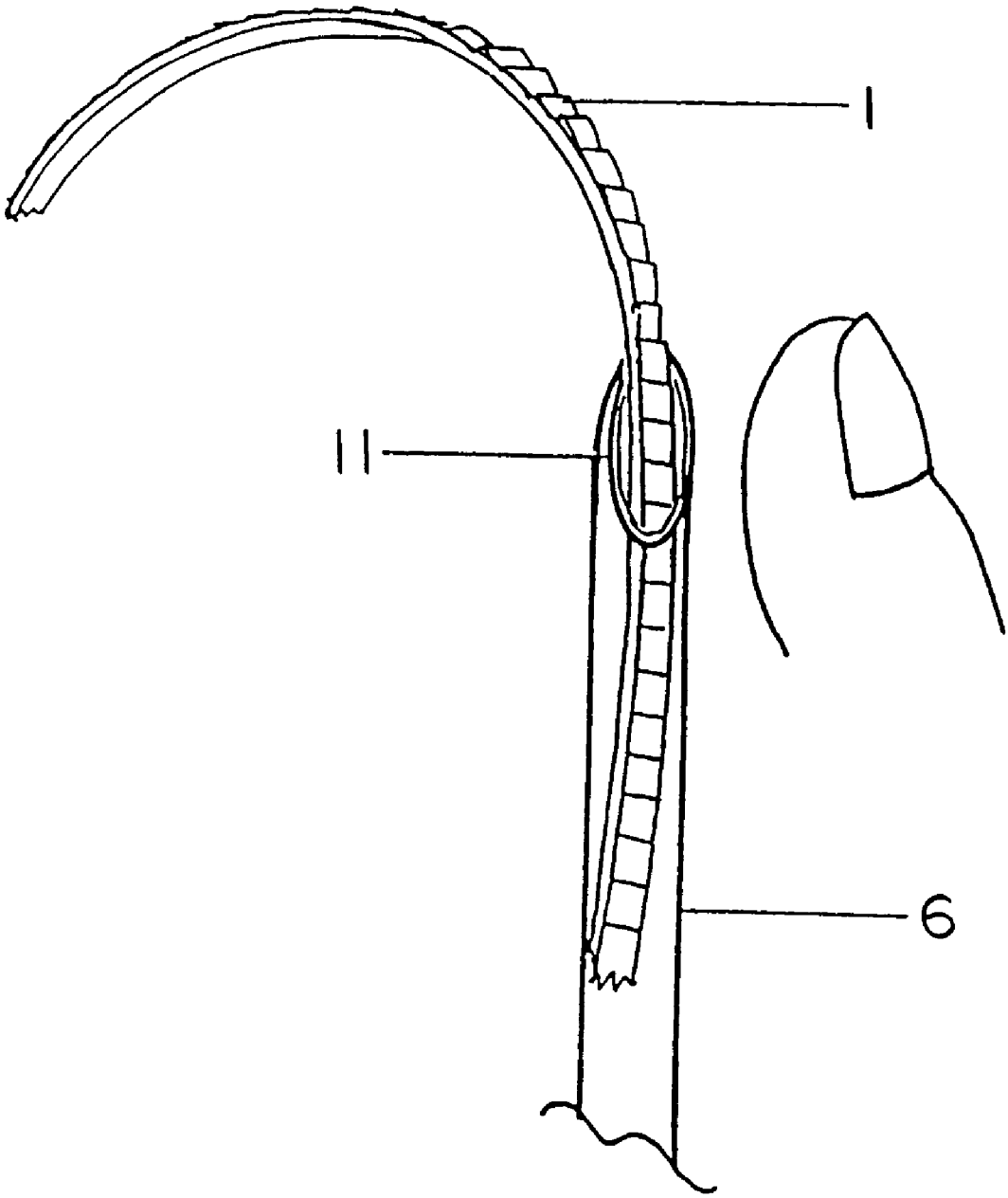
FIG. 3 shows in perspective the pipette assembly of the first embodiment with a modified pipette tube [6] provided with a means [11] to support the piston rod [1].
Figure 7:
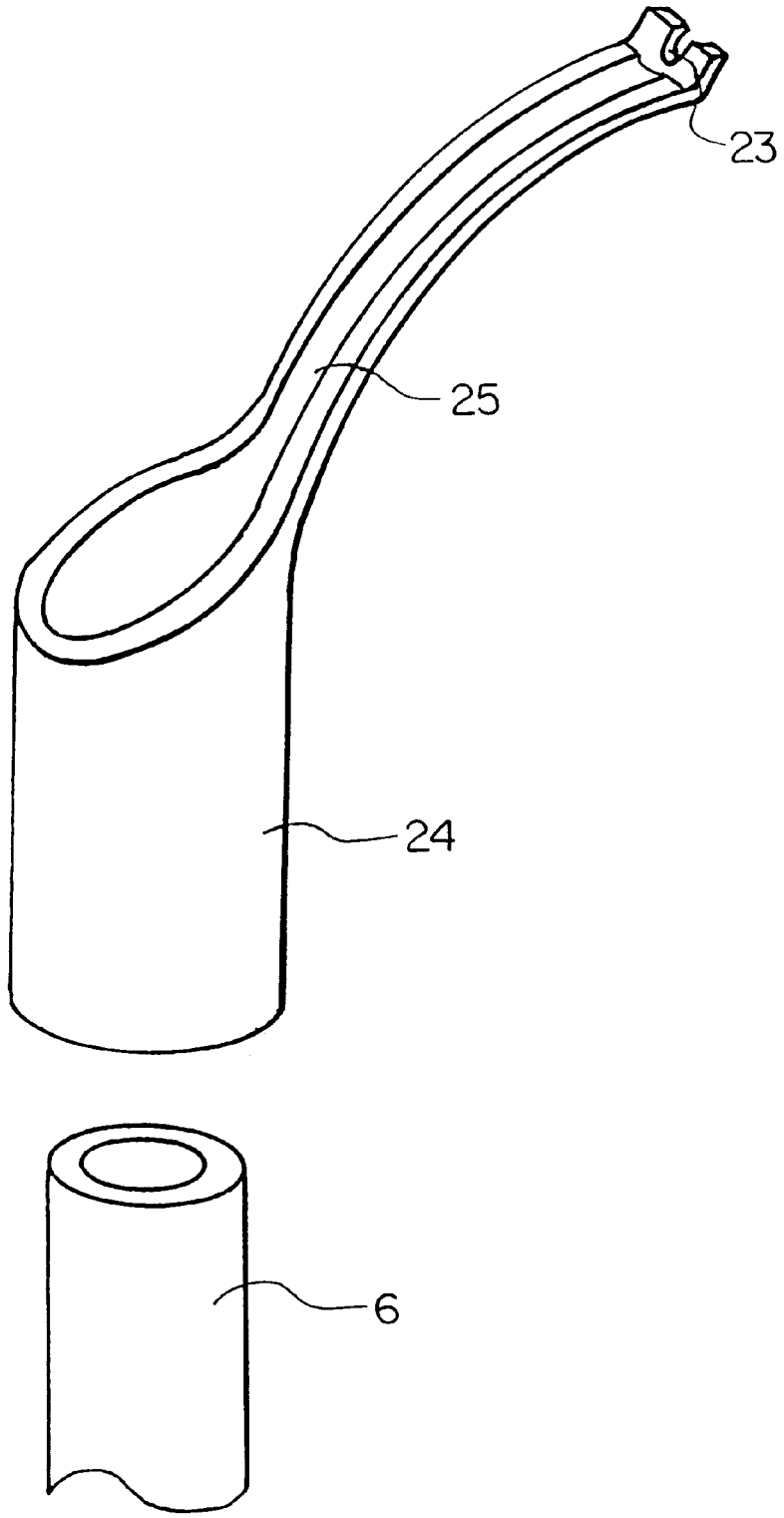
FIG. 7 shows an exploded perspective view of a guide cap [24] and the pipette to [6] in a modification to the first embodiment of the invention.

Another modification is shown in FIG. 3 where the pipette tube [6] is formed at its non-dispensing end [11], so that the pipette tube [6] is equipped with a means to improve control of the piston rod [1 . In FIG. 3 this means is provided by slanting the end [11] of the tube [6]. It will be appreciated that the actual configuration of the means can take various forms, only one of which is shown in FIG. 3. In a further example of a controlling means for the operation of the piston, FIG. 7 shows an end cap [24] which fits onto the non-dispensing end of the pipette tube [6]. The piston rod [not shown] passes through the guide cap [24] and is a snap fit into the lug [23], but runs freely through it and preferably in the groove [25].

Figure 8:
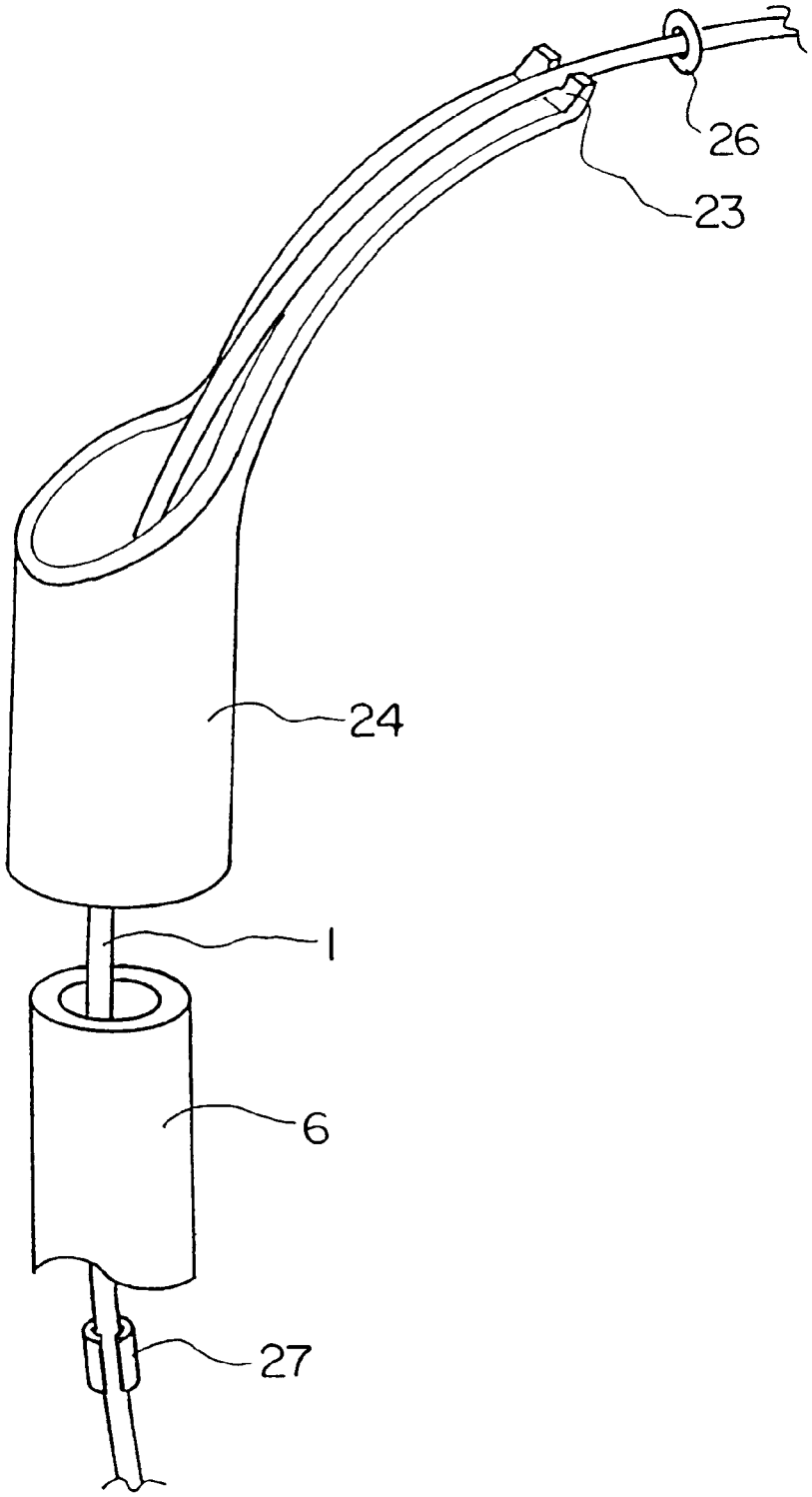
FIG. 8 shows a perspective view of the guide cap [24] of FIG. 7 supporting the piston rod [1] which is equipped with a top stopper [26] and bottom stopper [27].

In a further development shown in FIG. 8 the piston rod [1] is preferably equipped with a means to control the length of the piston stroke and thereby the volume of liquid dispensed, enabling the operate to dispense or suck up a preset volume repeatedly and directly. To achieve this, the piston rod may be equipped with a top stopper [26] and a bottom stopper [27] that are slidingly positionable on the piston rod [1].

To set the equipment for repeatedly dispensing a certain volume, the top stopper [26] is set against the external surface of the lug [23] with the piston head position sufficiently towards the jet end of the pipette tube [6] to enable the required volume to be drawn in. As the required volume is drawn into the pipette, the bottom stopper [27] is restrained by the lug [23] and the piston rod [1] slides through the stopper [27] so that when the required length of piston rod [1] is withdrawn, the bottom stopper [27] will be in position to restrain the piston rod [1] at the same point for subsequent operation of the equipment.

Figure 3A:
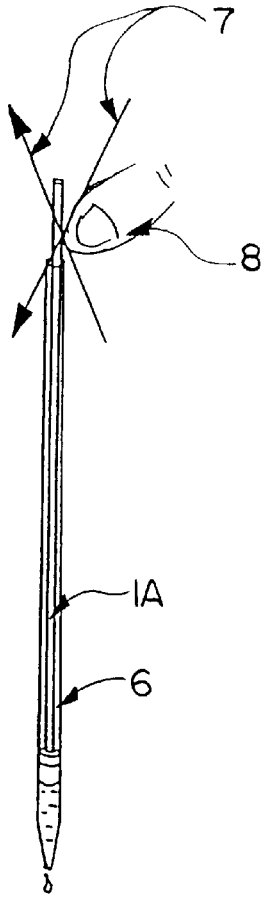
FIG. 3A shows in perspective a pipette assembly according to a second embodiment of the invention with a stiff piston rod [1A] being operated through a tangential force [7] by the thong [8].
Figure 3B:
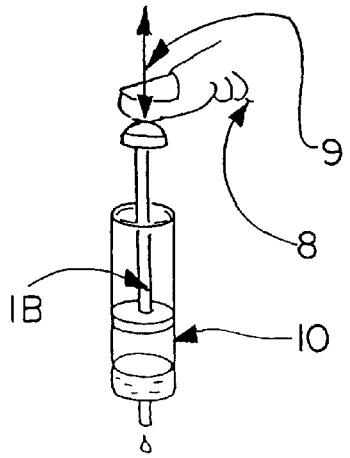
FIG. 3B PRIOR ART
FIG. 3B, by comparison, shows in perspective a known syringe [10] with a stiff piston rod [1B] being operated through a perpendicular force [9] by the thumb [8].

In a further embodiment of the invention, FIG. 3A shows the piston rod [1A] as a stiff construction and being operated by application of an inclined force [7] supplied by the thumb [8] to move the piston in the pipette tube [6]. In FIG. 3A an axial component of the applied force is moving the piston rod [1A], whereas a radial component of the applied force is sufficient to cause the piston rod [1A] frictionally to stick to the operator's thumb. By way of comparison, FIG. 3B shows a conventional syringe arrangement with the piston [1B] sliding in the syringe body [10] due to the application of a perpendicular force [9] by the thumb [8]. By applying the force [7] at an inclined angle to the piston rod [1] as in FIG. 3A it is practical to operate a long piston rod in stages manually for limitless length. However, when operating a piston rod manually with a perpendicular force, as in FIG. 3B, the length of the stroke is restricted to the length that the thumb [8] can stretch while the fingers are grasping the syringe body [10]. In order to provide a high coefficient of friction between the thumb and the piston rod [1A], the piston rod may be of a high friction material or have a high friction coating and/or have a serrated or knurled surface.

Figure 9:
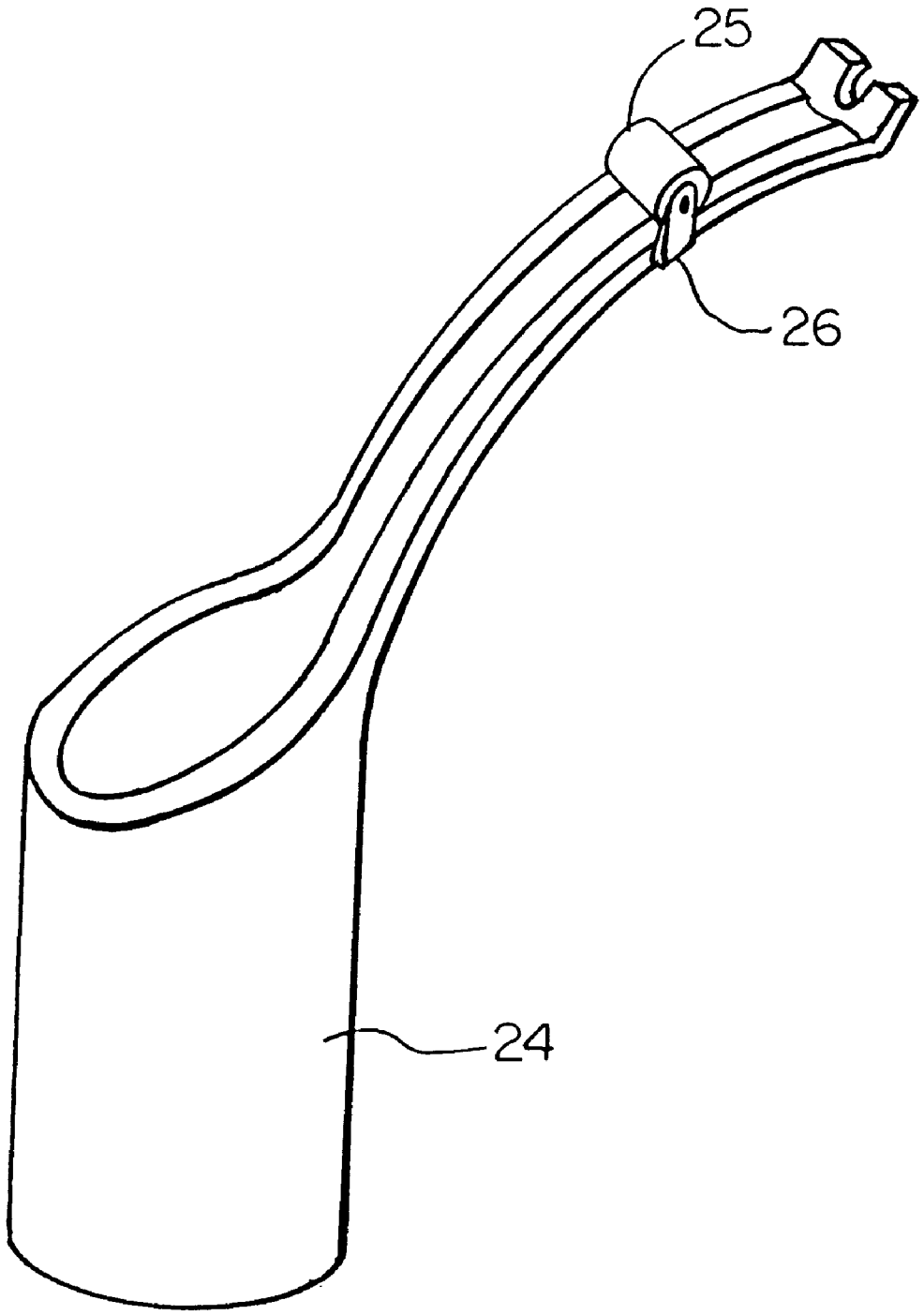
FIG. 9 shows in perspective a modified guide cap [24] with roller [25] supported by lugs [26].

FIG. 9 shows a modified guide cap (24) which is provided with a roller (25) supported by lugs (26). The roller (25) is operated by the thumb (not shown) to propel the piston rod (not shown). The roller (25) may be equipped with a suitable surface to increase traction between the roller (25) and the piston rod (not shown) and thumb (not shown).

It will be appreciated that there are many ways to adapt the device to receive a force to the side of the piston rod, only one of which is described here.

In a further development of the invention, the piston rod itself is tubular and the piston head is provided by an inflatable first bulb at one end of the piston rod tube in communication with the interior of the tube. A further bulb is attached to the other end of the tube also in communication with the interior of the tube. The further bulb has a first one-way valve between its interior and the interior of the tube, and a second one-way valve between its interior and the outside, and the one-way valves are orientated so that the further bulb when manually squeezed acts as a pump to inflate the first bulb by a desired amount. The piston can therefor be used with dispensing tubes of differing internal diameters and an effective seal can be achieved between the piston head and the dispensing tube. Conveniently, a pressure release valve is also provided for releasing the pressure in the piston rod tube.

I claim:

1. A dispensing device comprising a tube having a dispensing nozzle at one end and the other end being open, a piston head slidable in the tube, and a piston rod extending from the piston head and projecting from the open end of the tube, wherein the surface of the piston rod has a high coefficient of friction such that a force applied to the side of the piston rod adjacent the open end of the tube, by application by a digit of a user to the side of the piston rod adjacent the open end of the tube and at an inclined angle to the axis of the tube, can have a frictional component sufficient to move the piston rod and piston head along the tube.

2. A device as claimed in claim 1, wherein the surface of the piston rod is serrated or knurled.

3. A device as claimed in claim 1, further comprising means disposed adjacent the open end of the tube to support the piston rod to one side against a force applied by the user's digit to the opposite side.

4. A device as claimed in claim 1 wherein the piston rod is stiff.

5. A device as claimed in claim 1, wherein the piston rod is flexible.

6. A dispensing device comprising a tube having a dispensing nozzle at one end and the other end being open, a piston head slidable in the tube, and a piston rod extending from the piston head and projecting from the open end of the tube so that the piston rod and piston can be manually moved along the tube, the piston rod being flexible so that as the piston head is urged by the piston rod towards the dispensing nozzle the piston rod is supported at least part-way along its length by the tube and that portion of the piston rod outside the tube curls up due to "plastics memory".

7. A device as claimed in claim 6 and in the form of a pipette and in which the tube is graduated.

8. A device as claimed in claim 6, wherein the piston is formed of flexible material and the diameter of piston head is adjustable by suitable means.

9. A device as claimed in claim 6, wherein the piston head is continuous with, and of the same material as, the piston rod.

10. A device as claimed in claim 6, wherein the piston rod is equipped with stoppers that are slidingly adjustable on the piston rod.

11. A device as claimed in claim 6, wherein the piston rod has an outer cross-sectional dimension which is substantially smaller than the inner cross-sectional dimension of the tube.

12. A device according to claim 1, wherein the piston head is in the form of an inflatable bulb slidable in the tube, the piston rod is in the form of a tube extending from the piston head and projecting from the open end of the tube, the interior of the piston rod tube communicates with the interior of the bulb, an inflation bulb is provided at the other end of the piston and having an interior in communication with the interior of the piston rod tube, and valve means are provided to cause the inflation bulb to act as a pump when squeezed for inflating the inflatable bulb.

13. A method of dispensing fluid from a dispensing device comprising a tube having a dispensing nozzle at one end and the other end being open, a piston head slidable in the tube, and a piston rod extending from the piston head and projecting from the open end of the tube, the method comprising the step of applying by a digit a force to the side of the piston rod adjacent the open end of the tube and at an inclined angle to the axis of the tube, such that the frictional component of the force is sufficient to move the piston rod and the piston head along the tube.

* * * * *